US008245337B2

(12) United States Patent
Rabess et al.

(10) Patent No.: US 8,245,337 B2
(45) Date of Patent: Aug. 21, 2012

(54) BABY PORTABLE BED/SECURE DEVICE

(76) Inventors: Clifford Rabess, Rainham Village (GB); Lisa Rabess, Rainham Village (GB)

( * ) Notice: Subject to any disclaimer, the term of this patent is extended or adjusted under 35 U.S.C. 154(b) by 196 days.

(21) Appl. No.: 12/762,309

(22) Filed: Apr. 17, 2010

(65) Prior Publication Data

US 2011/0191956 A1 Aug. 11, 2011

(30) Foreign Application Priority Data

Feb. 10, 2010 (GB) ..... 1002104.6

(51) Int. Cl.
*A47C 16/00* (2006.01)

(52) U.S. Cl. ..... 5/655; 5/632

(58) Field of Classification Search ..... 5/655, 603, 5/630, 632, 420, 739
See application file for complete search history.

(56) References Cited

U.S. PATENT DOCUMENTS 6,381,787 B1 * 5/2002 Rogone et al. ..... 5/655

* cited by examiner

*Primary Examiner* — Robert G Santos
*Assistant Examiner* — Nicholas Polito

(57) ABSTRACT

A baby portable bed and secure device, —Snugsabug®—, for keeping baby in position while asleep or laying.

8 Claims, 4 Drawing Sheets

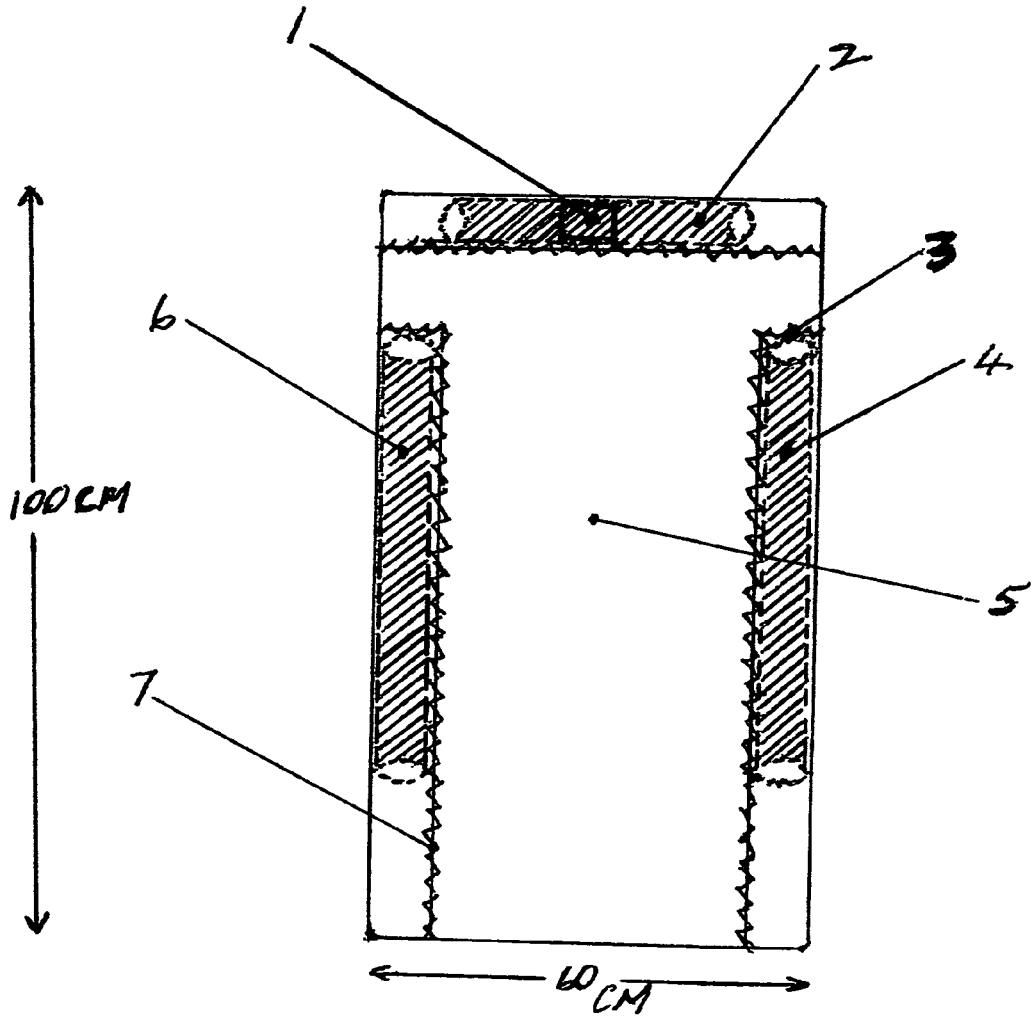
FIGURE 1. (TOP VIEW)

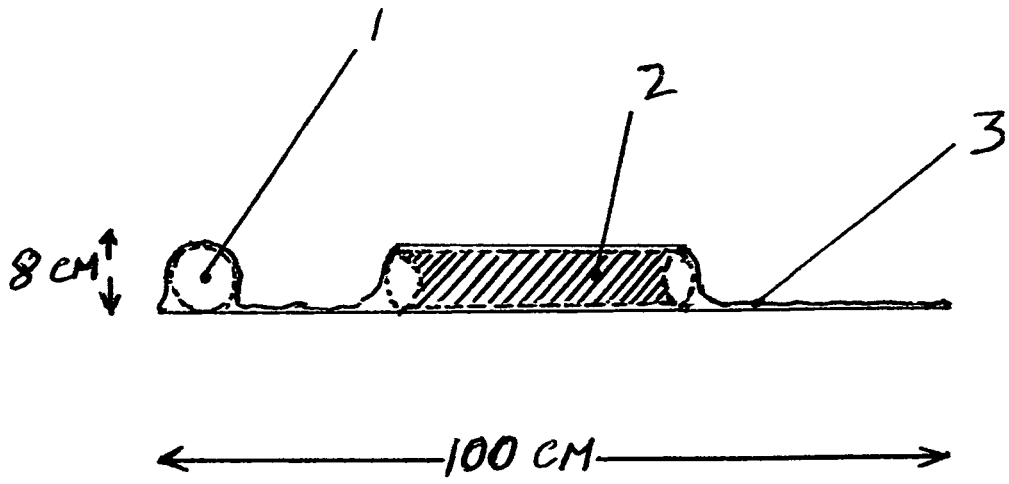
FIGURE 2. [SIDE VIEW]

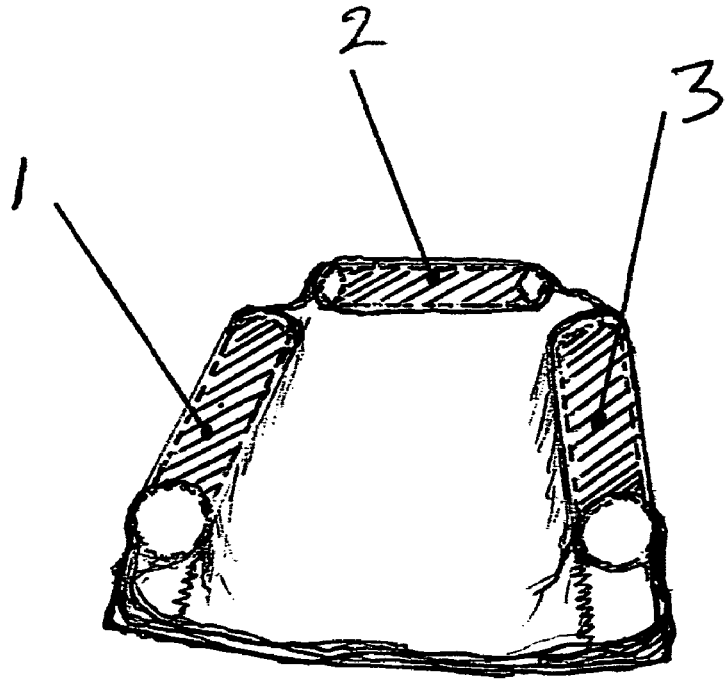
FIGURE 3. [BOTTOM VIEW]

TO NARROW

TO WIDEN

BABY PORTABLE BED/SECURE DEVICE

This invention relates to a device for keeping babies snug and in position whilst asleep or laying down.

Great care is to be taken not to allow babies to roll over whilst laying down or asleep. This would usually cause babies difficulty in breathing if their faces are smothered by fabric or mattress they are lying on. They also become distressed and uncomfortable.

By using a Snugsabug®, a baby portable bed/secure device, baby is kept in a secure position at the same time being snug and comfortable and rolling over is prevented.

An example of the invention will now be described by referring to the accompanying drawings:

FIG. 1-1 shows the baby portable bed/secure device logo.

2, 4 and 6 are foam tubing inserts covered by fabric that form bumpers and kept rigid in place by stitching on the fabric.

7 shows the channel of stitching on the left and right side, that allows the movement of the foam bumpers up or down—but is kept to a maximum position 3.

3 shows how this maximum stop position is made possible by stitching horizontally across. This stop position prevents the bumpers 6 and 4 from going to high above baby's shoulder but leaves a gap for baby's head.

The overall dimension 100 cm×60 cm.

FIG. 2-*shows* the side view of the invention.

1-Shows the top foam bumper which would be just above baby's head.

2-Shows the side foam bumper.

3-Shows the fabric covering.

Note the gap between 2 and 1 which represents a space for baby's head.

FIG. 3—shows the bottom view of the baby portable bed /secure device.

Figure 4A:
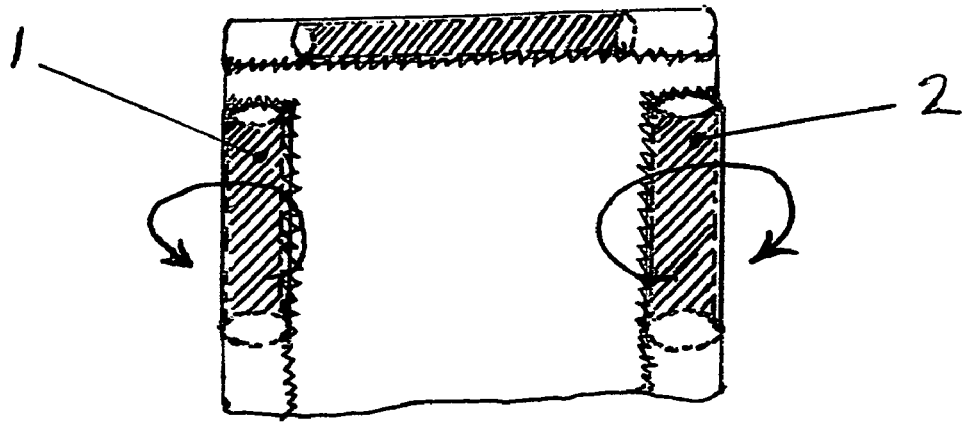
Figure 4B:
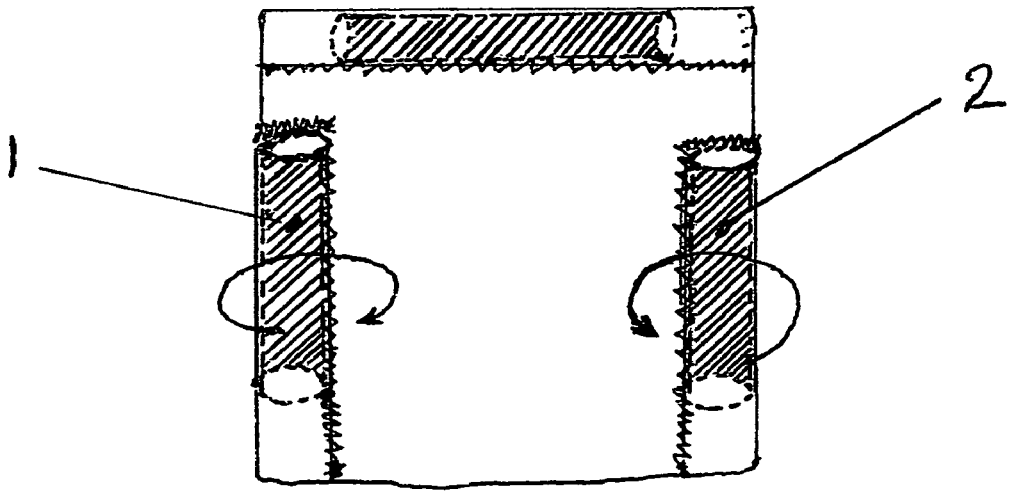

FIGS. 4*a* and 4*b* shows how to Narrow and how to Widen the baby portable bed/secure device depending on baby's size.

To make narrow, you twist the left hand side (as you look at it) bumper anti-clockwise and twist clockwise the right hand side bumper.

To widen you twist the left hand side bumper clockwise and twist the right hand side bumper anti-clockwise.

The invention claimed is:

1. A baby portable bed/secure device, comprising:

a cover comprising a top sheet and a bottom sheet, wherein the top sheet is sewn to the bottom sheet to create;

a pair of longitudinal side channels for a pair of side bumpers, and a transverse top channel for a top bumper;

a pair of side bumpers sized to translate within the pair of longitudinal side channels; and a top bumper sized to fit within the transverse top channel;

wherein a gap is defined between the top of the pair of side bumpers and the bottom of the top bumper to allow a baby's head to be free, the gap being created by a transverse line of stitching through the top sheet to limit the topmost longitudinal position of the pair of side bumpers.

2. A baby portable bed/secure device according to claim 1, made mainly of fabric for keeping baby in position when laying or sleeping thus preventing baby from rolling.

3. A baby portable bed/secure device according to claim 2, in which the pair of side bumpers are made of foam and can rotate clockwise and anti-clockwise.

4. A baby portable bed/secure device according to claim 3, in which the pair of side bumpers are able to slide up and down along the pair of longitudinal side channels to a topmost position, this topmost position is formed by the transverse line of stitching.

5. A baby portable bed/secure device according to claim 1, in which the pair of longitudinal side channels and the transverse line of stitching allows the pair of side bumpers to reach no higher than a baby's shoulder to allow a gap between the pair of side bumpers and the top bumper.

6. A baby portable bed/secure device according to claim 5, in which the to bumper can rotate towards a baby's head thus creating a gap for a baby's head to be free.

7. A baby portable bed/secure device according to claim 1, that is fully portable.

8. A baby portable bed/secure device according to claim 1, that is fully adjustable.

* * * * *